US010080478B2

(12) United States Patent
Jeong et al.

(10) Patent No.: US 10,080,478 B2
(45) Date of Patent: Sep. 25, 2018

(54) RACK ASSEMBLY AND DISHWASHER HAVING THE SAME

(71) Applicant: SAMSUNG ELECTRONICS CO., LTD., Suwon-si, Gyeonggi-do (KR)

(72) Inventors: Heon Ho Jeong, Hwaseong-si (KR); Jae-Moon Lee, Seoul (KR); Jae Jun Kim, Seoul (KR); Ji-Young Shin, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 254 days.

(21) Appl. No.: 14/578,839

(22) Filed: Dec. 22, 2014

(65) Prior Publication Data

US 2015/0182104 A1 Jul. 2, 2015

(30) Foreign Application Priority Data

Dec. 31, 2013 (KR) ..... 10-2013-0169567

(51) Int. Cl.
*A47L 15/50* (2006.01)

(52) U.S. Cl.
CPC ..... *A47L 15/502* (2013.01); *A47L 15/505* (2013.01)

(58) Field of Classification Search
CPC .... A47L 15/505; A47L 15/502; A47L 15/503; B08B 3/045; B08B 3/047; B08B 3/06; A47J 43/24; A47J 47/14; A47J 47/20; A47B 2210/0091; A47F 5/108
See application file for complete search history.

(56) References Cited

U.S. PATENT DOCUMENTS 5,098,676 A * 3/1992 Brooks, Jr. ..... A61B 50/33 206/438
5,407,648 A * 4/1995 Allen ..... A61L 2/26 206/438
2004/0079713 A1 4/2004 Wendt et al.
2005/0095169 A1* 5/2005 Su-Syin ..... A61L 2/07 422/28
2007/0056919 A1 3/2007 Moore
2008/0156362 A1 7/2008 Shin et al.
(Continued)

FOREIGN PATENT DOCUMENTS

CN 1552277 A 12/2004
CN 102599870 A 7/2012
(Continued)

OTHER PUBLICATIONS

Extended European Search Report dated Mar. 9, 2015 in corresponding European Patent Application No. 14198765.1.
(Continued)

*Primary Examiner* — Joseph L. Perrin
*Assistant Examiner* — Irina Graf
(74) *Attorney, Agent, or Firm* — Staas & Halsey LLP

(57) ABSTRACT

A rack assembly and a dishwasher having the same, the rack assembly includes a basket in which a plurality of holes are formed; and a loading plate that is disposed to be separable from the basket and to be deformable so that loading plate and the materials to be washed placed thereon are removable from the basket. Through this configuration, loading and unloading of the materials to be washed can be easily performed.

14 Claims, 9 Drawing Sheets

(56) References Cited

U.S. PATENT DOCUMENTS

| | | | | |
|---|---|---|---|---|
| 2008/0179264 | A1* | 7/2008 | Abrams | A47L 19/02 211/41.3 |
| 2009/0038656 | A1* | 2/2009 | Ahrenholtz | A47L 15/505 134/135 |
| 2010/0155280 | A1 | 6/2010 | Graute et al. | |
| 2012/0181242 | A1* | 7/2012 | Jeong | A47L 15/502 211/70.7 |
| 2014/0162207 | A1* | 6/2014 | Hawkes | A61C 19/02 433/77 |
| 2014/0263111 | A1* | 9/2014 | Micek | A47L 19/04 211/41.6 |

FOREIGN PATENT DOCUMENTS

| | | | |
|---|---|---|---|
| EP | 1 568 304 | A2 | 8/2005 |
| EP | 1787568 | | 5/2007 |
| EP | 2 554 097 | A2 | 2/2013 |
| KR | 10-2008-0062619 | | 7/2008 |
| KR | 10-2012-0084161 | | 7/2012 |

OTHER PUBLICATIONS

Chinese Office Action dated Apr. 4, 2018, in corresponding Chinese Patent Application No. 201410841774.7.

* cited by examiner

RACK ASSEMBLY AND DISHWASHER HAVING THE SAME

CROSS-REFERENCE TO RELATED APPLICATIONS

This application claims the benefit of Korean Patent Application No. 10-2013-0169567, filed on Dec. 31, 2013 in the Korean Intellectual Property Office, the disclosure of which is incorporated herein by reference.

BACKGROUND

1. Field

Embodiments of the present disclosure relate to a dish washing machine configured so that loading and unloading of materials to be washed can be easily performed.

2. Description of the Related Art

In general, a dishwasher is a device that washes dishes by spraying high-pressure washing water onto the dishes and generally undergoes pre-washing, main washing, rinsing, and drying operations. In the pre-washing operation, residues are removed from the dishes by spraying the washing water without adding detergent. In the main washing operation, the dishes can be washed by spraying the washing water and simultaneously adding the detergent by using a detergent supply unit.

In general, the dishwasher includes a cabinet in which a washing tub is disposed, a rack assembly that accommodates the dishes and is installed to move back and forth in the washing tub, and a spray unit that sprays the washing water into the rack assembly. The washing water sprayed by the spray unit is used to wash the dishes.

Conventionally, dishes and utensils such as spoons, chopsticks and cutlery are pressed or inserted into predetermined fixing protrusions of the rack assembly. Thus, when a large amount of dishes is washed, there is an inconvenience in that it takes a long time to load the dishes.

SUMMARY

Therefore, it is an aspect of the present disclosure to provide a rack assembly having an improved structure in which loading and unloading of materials to be washed can be easily performed, and a dishwasher having the rack assembly.

Additional aspects of the disclosure will be set forth in part in the description which follows and, in part, will be apparent from the description, or may be learned by practice of the disclosure.

In accordance with one aspect of the present disclosure, there is provided a rack assembly in which washing of materials to be washed is performed in a washing tub, the rack assembly including: a basket in which a plurality of holes are formed; and a loading plate that is disposed to be separated from the basket and to be deformable so that the materials to be washed placed on the loading plate can be removed from the basket.

The loading plate may have a first state in which the loading plate is mounted on the basket, and a second state in which the loading plate is removed from the basket, and the loading plate may be deformed elastically from the first state to the second state.

The basket may include: a bottom portion; and a plurality of support holders that protrude from the bottom portion, and the loading plate may include: a loading portion disposed to face the bottom portion in the first state; and a plurality of mounting holes that are formed in the loading portion and are configured so that the plurality of support holders can pass through the plurality of holes in the first state.

When the loading plate is moved from the first state to the second state, the loading plate may be deformed by weights of the materials to be washed on the loading plate.

The loading plate may include: a pair of dispersion plate portions on which the materials to be washed are disposed; and a gathering plate portion which is disposed adjacent to the dispersion plate portion and in which the materials to be washed are gathered in the second state.

The loading plate may be deformable so that the gathering plate portion can be disposed to be lower than the pair of dispersion plate portions.

The gathering plate portion may be formed more concave than the pair of dispersion plate portions.

The loading plate may further include a guide portion that is formed at both ends of the gathering plate portion and protrudes upward so as to prevent the materials to be washed from sliding off the loading plate.

The plurality of support holders may include: first support holders; and second support holders each having a smaller height than that of each of the first support holders, and the first support holders and the second support holders may be alternately disposed.

The bottom portion may include: a first bottom portion; and a second bottom portion that is formed to have a smaller height than that of the first bottom portion.

The plurality of support holders may be formed on the first bottom portion.

The plurality of support holders may be arranged in a plurality of lines.

The mounting holes may be formed to have a larger cross-sectional area than that of each of the support holders.

The loading plate may be disposed to be in close contact with the bottom portion.

The loading plate may include a pair of handles that are configured at both ends of the loading plate so that the loading plate can be removed from the basket.

The loading plate may be formed with a material including at least one of rubber and silicon.

The rack assembly may further include a movement frame on which the basket is placed and which is disposed to be pulled out from the washing tub.

In accordance with another aspect of the present disclosure, there is provided a dishwasher including: a cabinet; a washing tub which is disposed in the cabinet and in which washing of materials to be washed is performed; and a rack assembly disposed to be pulled out from an inside of the washing tub, wherein the rack assembly may include: a basket including a bottom portion and a plurality of support holders that protrude from the bottom portion so as to support the materials to be washed; and a loading plate that includes a loading portion corresponding to the bottom portion and a plurality of mounting holes disposed on the loading portion so that the plurality of support holders can pass through the plurality of mounting holes, that is disposed to be removed from the basket and is configured to be deformable.

The loading plate may be moved between a first state in which the loading plate is mounted on the basket and the plurality of support holders are inserted into the plurality of mounting holes and a second state in which the loading plate is removed from the basket and the plurality of support holders are removed from the plurality of mounting holes, and the loading plate may include: a dispersion plate portion on which the materials to be washed are disposed; and a gathering plate portion which is disposed adjacent to the dispersion plate portion and in which the materials to be washed are gathered, and the loading plate in the second state is deformed so that the gathering plate portion can be disposed to be lower than the dispersion plate portion.

The basket may include: a first bottom portion which corresponds to the dispersion plate portion and in which the plurality of support holders are formed; and a second bottom portion that is disposed adjacent to the first bottom portion and corresponds to the gathering plate portion.

The second bottom portion may be formed to be lower than the first bottom portion.

In accordance with still another aspect of the present disclosure, there is provided a rack assembly having a basket in which materials to be washed are disposed, wherein the basket may include: a bottom portion; and a plurality of support holders that protrude from the bottom portion so as to support the materials to be washed and include first support holders and second support holders each having a smaller height than that of each of the first support holders and disposed adjacent to the first support holders.

The plurality of support holders may be disposed in a lattice form.

The rack assembly may further include: a loading portion corresponding to the bottom portion; and a loading plate that has a plurality of mounting holes disposed in the loading portion so that the plurality of support holders can pass through the plurality of mounting holes, that is disposed to be removed from the basket and is configured to be deformable.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
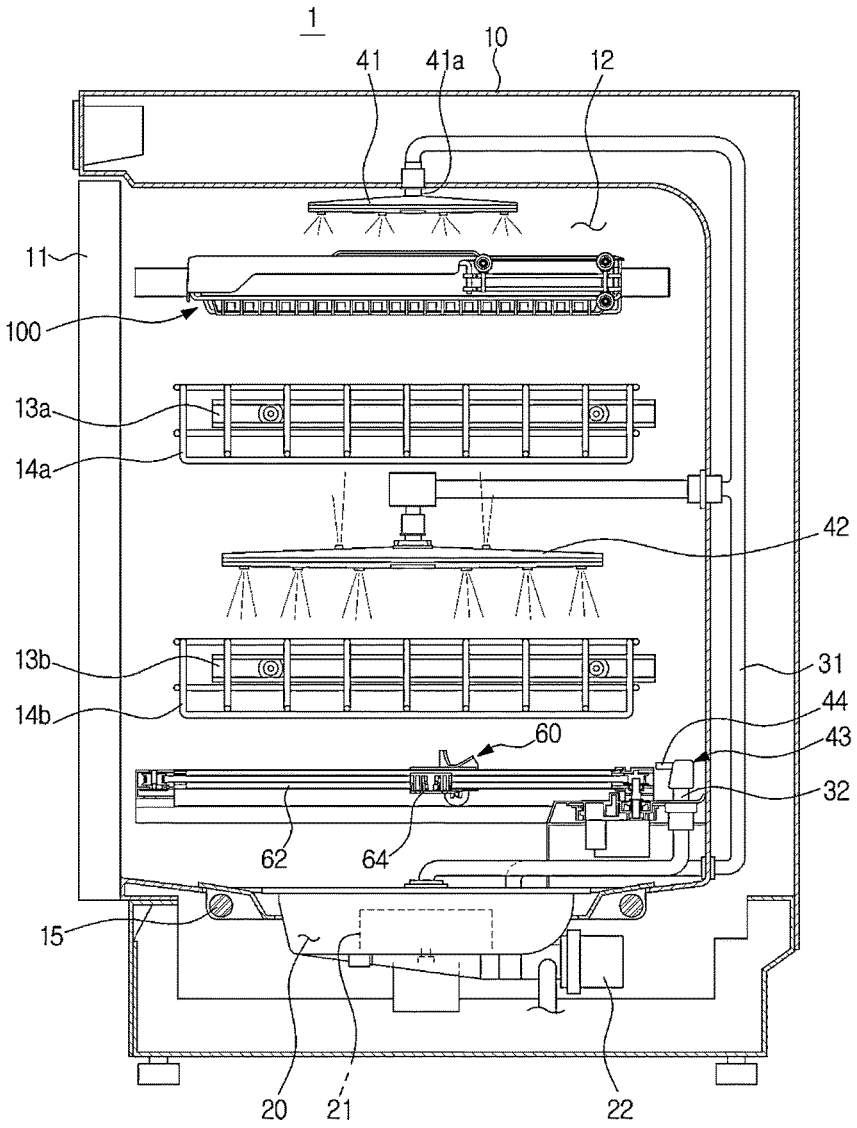
FIG. 1 is a cross-sectional view of a dishwasher according to an embodiment of the present disclosure.

Reference will now be made in detail to the embodiments of the present disclosure, examples of which are illustrated in the accompanying drawings, wherein like reference numerals refer to like elements throughout.

Hereinafter, embodiments of the present disclosure will be described with reference to the drawings in detail.

FIG. 1 is a cross-sectional view of a dishwasher according to an embodiment of the present disclosure. A dishwasher 1 includes a cabinet 10 that constitutes an exterior, a washing tub 12 disposed in the cabinet 10, rack assemblies 14*a*, 14*b*, and 100 that are disposed in the washing tub 12 and accommodate dishes, a sump 20 that collects and stores washing water, and spray units 41, 42, and 43 that spray the washing water.

The washing tub 12 is disposed in an approximately box shape and has an open front side through which the dishes can be put in and taken out. The open front side of the washing tub 12 may be opened/closed by a door 11. The door 11 may be rotatably coupled to the cabinet 10.

The rack assemblies 14*a* and 14*b* may include an upper rack assembly 14*a* and a lower rack assembly 14*b*. The upper rack assembly 14*a* may be supported by an upper rack 13*a*, and the lower rack assembly 14*b* may be supported by a lower rack 13*b*. The upper rack 13*a* and the lower rack 13*b* may be disposed in the washing tub 12 to slide in forward/backward directions.

A washing pump 21 may be disposed at the sump 20 so as to pump stored water into the spray units 41, 42, and 43. The washing water pumped by the washing pump 21 may be supplied to the first spray unit 41 and the second spray unit 42 through the first supply pipe 31 or may be supplied to the third spray unit 43 through the second supply pipe 32.

Also, a heater 15 for heating the washing water and a drainage pump 22 for draining the washing water may be disposed at a lower portion of the washing tub 12.

As illustrated in FIG. 1, the first spray unit 41 may be disposed at an upper side of the upper rack assembly 14*a*, and the second spray unit 42 may be disposed between the upper rack assembly 14*a* and the lower rack assembly 14*b*, and the third spray unit 43 may be disposed below the lower rack assembly 14*b*.

Also, the first spray unit 41 may be disposed to rotate around a rotation shaft 41*a*, and the second spray unit 42 may be disposed to rotate around a rotation shaft.

The first spray unit 41 may spray the washing water toward the dishes accommodated in the upper rack assembly 14*a*, and the second spray unit 42 may spray the washing water toward the dishes accommodated in the upper rack assembly 14*a* and the lower rack assembly 14*b*.

The third spray unit 43 may be disposed to be fixed to one side of the washing tub 12, unlike the first spray unit 41 and the second spray unit 42. The third spray unit 43 may spray the washing water in an approximately horizontal direction. Thus, the washing water may not be sprayed by the third spray unit 43 directly toward the dishes.

The third spray unit 43 may include nozzles 44 through which the washing water is sprayed. The nozzles 44 may be spaced a predetermined distance apart from each other approximately from one side of the washing tub 12 to an opposite side thereof and may be arranged in a line.

A direction of the washing water sprayed through the nozzles 44 of the third spray unit 43 in the approximately horizontal direction, may be changed by a changing assembly 60 disposed in the washing tub 12 so that the washing water can be sprayed toward the dishes accommodated in the lower rack assembly 14*b*. The changing assembly 60 is confined in a guide rail 62 by using a holder 64 and is disposed to move along the guide rail 62.

Figure 2:
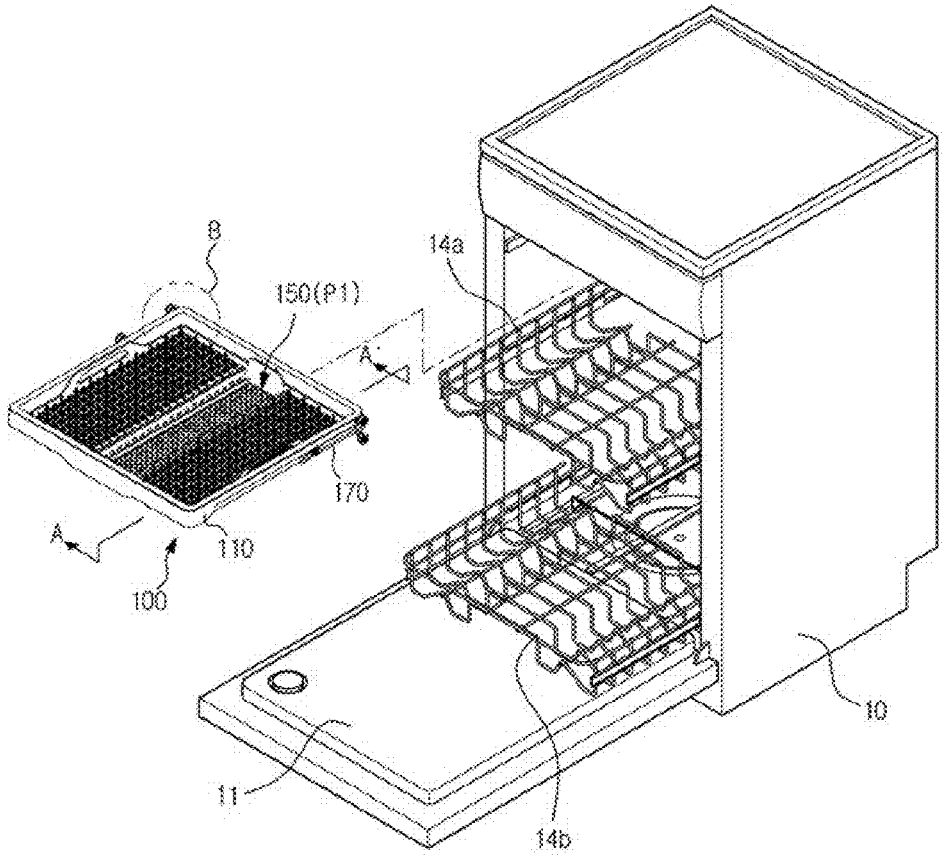
FIG. 2 is a perspective view of the dishwasher according to an embodiment of the present disclosure.
Figure 3:
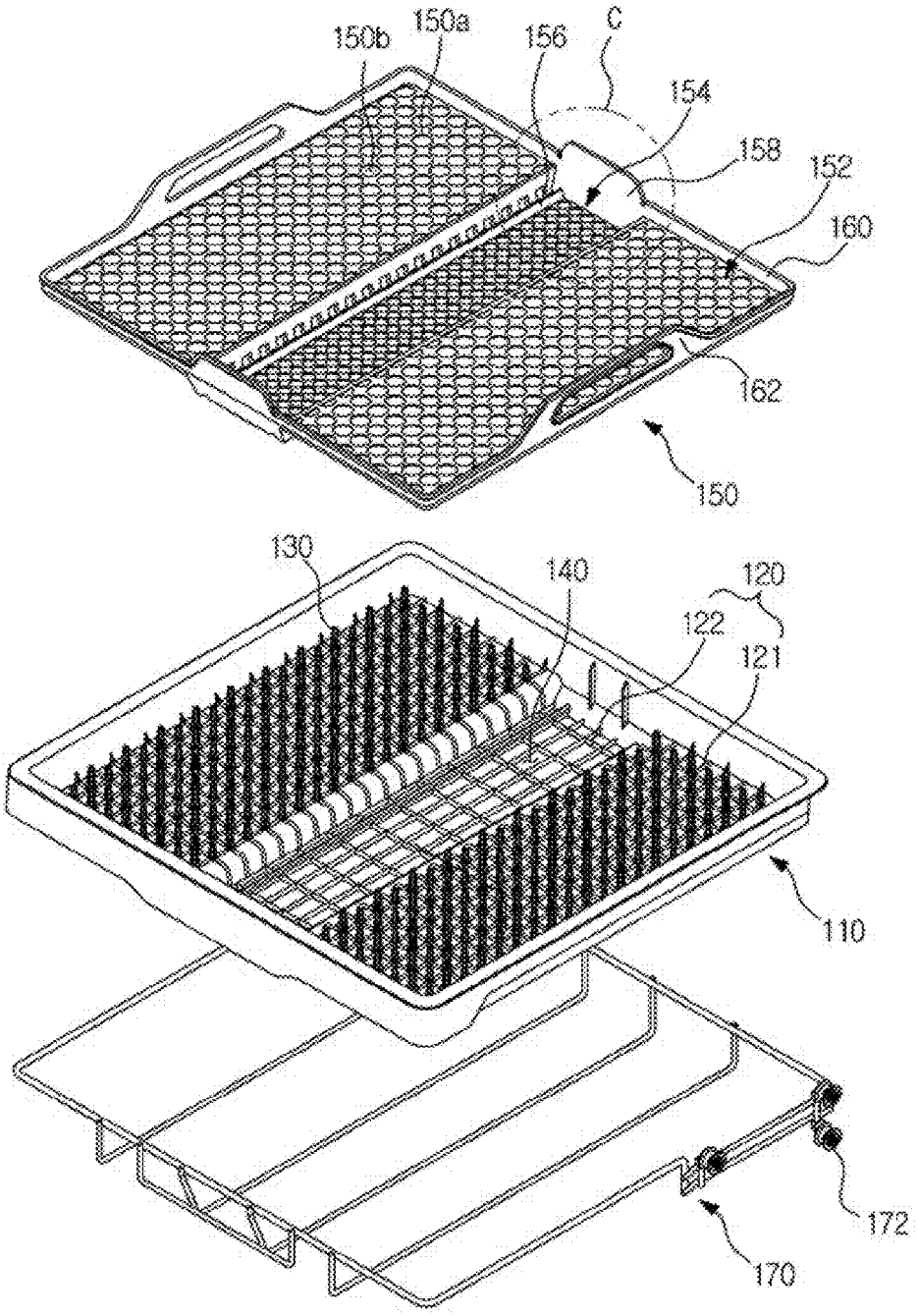
FIG. 3 is an exploded perspective view of a rack assembly according to an embodiment of the present disclosure.
Figure 4:
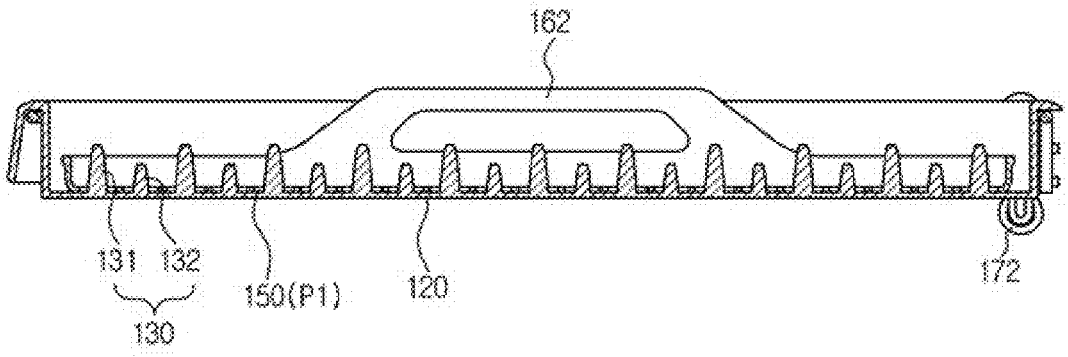
FIG. 4 is a cross-sectional view taken along a line A-A' of FIG. 2.
Figure 5:
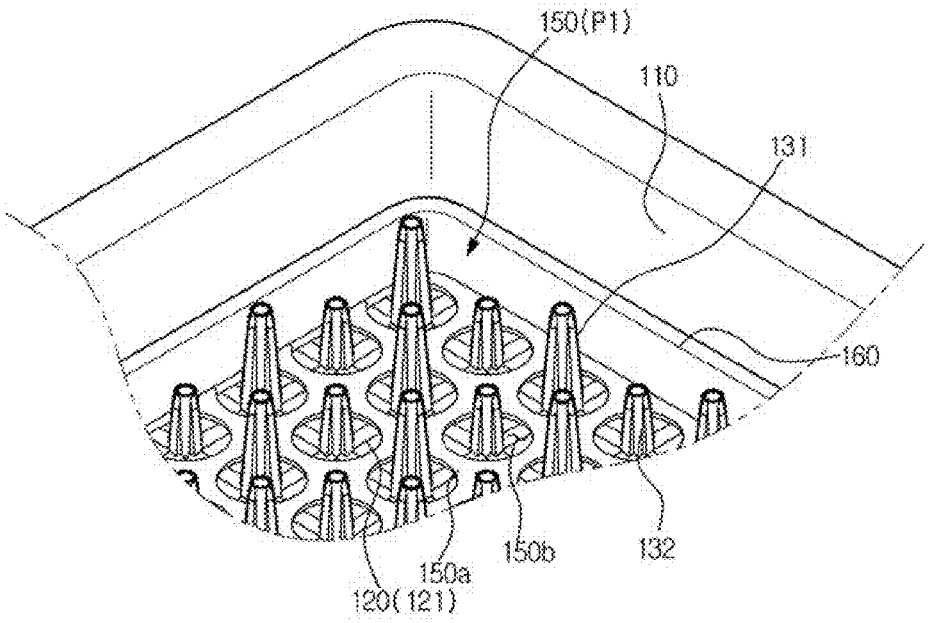
FIG. 5 is an enlarged view of a portion B of FIG. 2.
Figure 6:
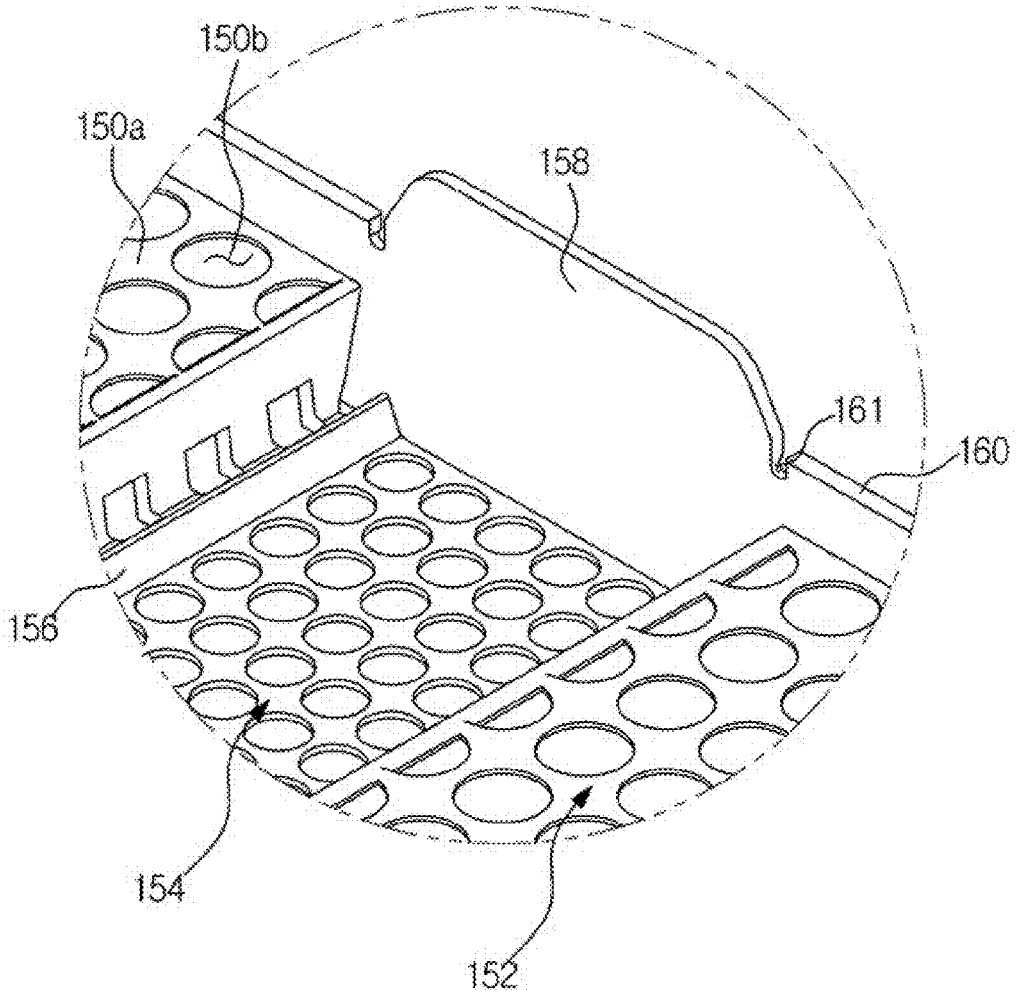
FIG. 6 is an enlarged view of a portion C of FIG. 3.

FIG. 2 is a perspective view of the dishwasher according to an embodiment of the present disclosure FIG. 3 is an exploded perspective view of a rack assembly according to an embodiment of the present disclosure, and FIG. 4 is a cross-sectional view taken along a line A-A' of FIG. 2, and FIG. 5 is an enlarged view of a portion B of FIG. 2, and FIG. 6 is an enlarged view of a portion C of FIG. 3.

A rack assembly 100 includes a basket 110.

The basket 110 may include a bottom portion 120 that supports materials to be washed and a plurality of support holders 130 that protrude from the bottom portion 120 so that the materials to be washed can be stacked on the basket 110. The materials to be washed may include dishes, cutlery, and spoons and chopsticks.

A plurality of holes 140 through which the washing water can pass, are formed in the bottom portion 120. In the current embodiment of the present disclosure, a plurality of wires are disposed to meet at right angles, and thus, the bottom portion 120 and the plurality of support holders 130 are formed. However, embodiments of the present disclosure are not limited thereto, and the plurality of holes 140 may be formed in the bottom portion 120, and the support holders 130 may be configured to protrude from the bottom portion 120 and to support the materials to be washed.

The bottom portion 120 may include a first bottom portion 121 and a second bottom portion 122.

The plurality of support holders 130 may be disposed on the first bottom portion 121, and the height of the second bottom portion 122 may be smaller than that of the first bottom portion 121. In the current embodiment of the present disclosure, the support holders 130 are disposed to be formed only at the first bottom portion 121.

The plurality of support holders 130 may be disposed on the first bottom portion 121 so as to support the materials to be washed. The second bottom portion 122 is configured in such a way that the materials to be washed each having a larger height than that of the first bottom portion 121 can be disposed at the second bottom portion 122. Through this configuration, a space between the rack assembly 100 and a configuration disposed at a top end of the rack assembly 100 can be minimized so that space utilization of the washing tub 12 can be improved.

The plurality of support holders 130 support a part of the materials to be washed so that an area in which the materials to be washed and the bottom portion 120 contact each other, can be reduced and a surface area washed by the washing water can be increased.

The plurality of support holders 130 may be disposed to be arranged side by side in a plurality of lines.

The plurality of support holders 130 includes first support holders 131 and second support holders 132 each having a smaller height than that of each of the first support holders 131. The arrangement of the first support holders 131 and the second support holders 132 is not limited. However, in the current embodiment of the present disclosure, the first support holders 131 and the second support holders 132 are alternately disposed.

That is, the support holders 130 may be disposed in a lattice form, and the second support holders 132 each having a smaller height than that of each of the first support holders 131 are disposed adjacent to the first support holders 131.

In this way, heights of the support holders 130 are different from each other so that the materials to be washed are not disposed in parallel to the bottom portion 120 but are disposed in an inclined state. For example, when the support holders 130 have the same height, the materials to be washed are supported by the support holders 130 so as to be disposed to be in parallel to the bottom portion 120. However, when the heights of the adjacent support holders 130 are different from each other, like in the current embodiment of the present disclosure, the materials to be washed are disposed to be inclined by a difference in heights of the first support holders 131 and the second support holders 132 each having a smaller height than that of each of the first support holders 131 so that a washing surface of the washing water can be increased.

The rack assembly 100 includes a loading plate 150.

The loading plate 150 is disposed to be separated from the basket 110. As will be described below, the loading plate 150 is disposed so that unloading of the materials to be washed can be easily performed.

The loading plate 150 is disposed to be deformable. The loading plate 150 may be disposed so that a loading portion 150*a* can be folded. In the current embodiment of the present disclosure, the loading plate 150 is formed of an elastic material and thus is formed to be bent or unfolded.

Figure 8:
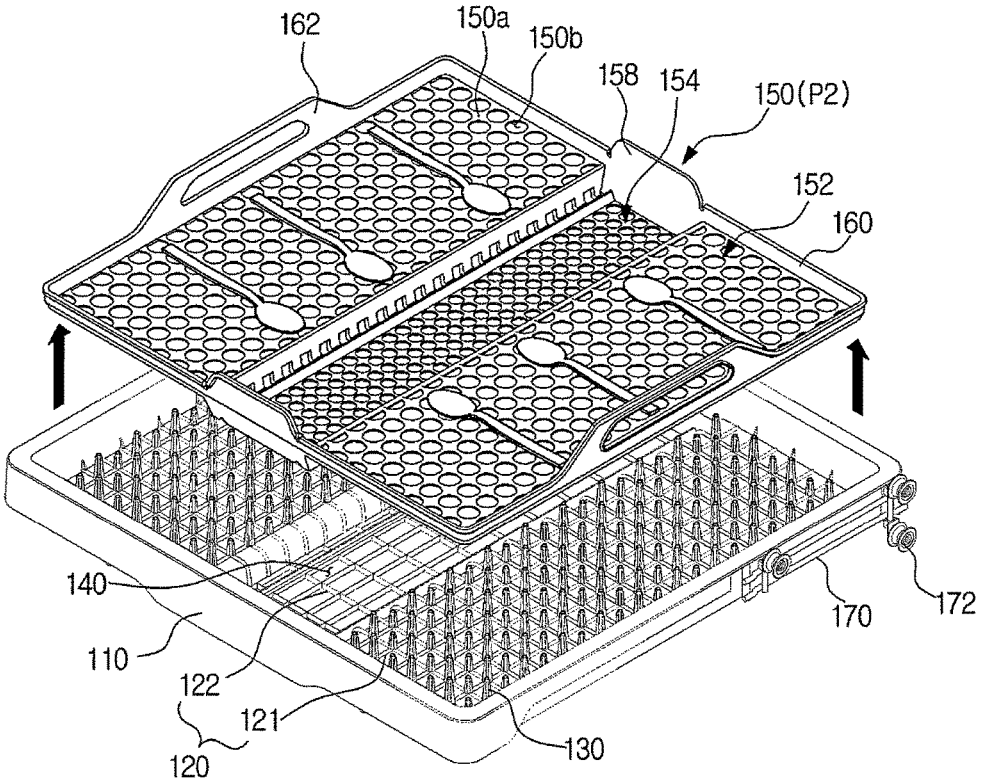

That is, the loading plate 150 may have a first state P1 in which the loading plate 150 is mounted on the basket 110, and a second state P2 in which the loading plate 150 is removed from the basket 110 (FIG. 8). When the loading plate 150 is moved from the first state P1 to the second state P2, the loading plate 150 may be deformed elastically. Deformation of the loading plate 150 may be generated by an external force or a load of the materials to be washed disposed on the loading plate 150. That is, the loading plate 150 is formed of an elastic material and is configured to be deformable.

The loading plate 150 is formed to correspond to the bottom portion 120 of the basket 110. The loading plate 150 has a plurality of mounting holes 150*b* through which the plurality of support holders 130 pass. The loading plate 150 is disposed to be removed from the basket 110.

In detail, the loading plate 150 may include the loading portion 150*a* that corresponds to the bottom portion 120 of the basket 110 and the plurality of mounting holes 150*b* that correspond to the support holders 130 of the basket 110. When the loading plate 150 is in the first state P1, the support holders 130 may pass through the plurality of mounting holes 150*b*, and the bottom portion 120 and the loading portion 150*a* may be formed to face each other. When the loading plate 150 is in the second state P2, the support holders 130 are removed from the plurality of mounting holes 150*b*, and the bottom portion 120 and the loading portion 150*a* are spaced apart from each other.

The materials to be washed are stacked in the first state P1 in which the loading plate 150 is mounted on the basket 110. In this case, since the support holders 130 are disposed to pass through the mounting holes 150*b*, the materials to be washed are supported by the support holders 130. Since the materials to be washed are supported by the support holders 130, the materials to be washed are configured to be suspended in the support holders 130 so that an upper portion of the loading portion 150*a* may not be easily moved. After a washing operation is finished, the loading plate 150 is moved to the second state P2 in which the loading plate 150 is removed from the basket 110, the support holders 130 are removed from the mounting holes 150*b*, and the materials to be washed are not supported by the support holders 130 any more. Thus, the materials to be washed may slide on the loading portion 150*a* of the loading plate 150 and may be moved. In this case, the loading plate 150 may be flexibly deformed and thus is bent by a load of the materials to be washed.

The plurality of support holders 130 may be disposed to be inserted into the plurality of mounting holes 150*b* that correspond to the plurality of support holders 130. Through this configuration, the loading plate 150 may be mounted on the basket 110 without distortion in the first state P1. In this case, a width of each of the mounting holes 150*b* may be greater than a cross-sectional area of each of the support holders 130. The mounting holes 150*b* may be formed to have a larger cross-sectional area than that of each of the support holders 130 so that the washing water can be discharged through the mounting holes 150*b*.

The loading plate 150 may include a dispersion plate portion 152 and a gathering plate portion 154.

The materials to be washed are disposed at the dispersion plate portion 152, and the gathering plate portion 154 is disposed adjacent to the dispersion plate portion 152, and the materials to be washed are disposed to be gathered when the loading plate 150 is disposed in the second state P2. In detail, the materials to be washed may be placed on both the dispersion plate portion 152 and the gathering plate portion 154. When the loading plate 150 is moved from the first state P1 to the second state P2, the materials to be washed are disposed to be moved to the gathering plate portion 154.

To this end, the loading plate 150 may be deformed in such a way that the gathering plate portion 154 is disposed to be lower than the dispersion plate portion 152. That is, in the second state P2, the loading plate 150 is deformed in such a way that the gathering plate portion 154 is disposed lower than the dispersion plate portion 152 and thus, the materials to be washed are gathered.

The mounting holes 150*b* through which the support holders 130 pass are formed in the dispersion plate portion 152. The materials to be washed are gathered on the gathering plate portion 154 due to deformation of the loading plate 150. The arrangement of the dispersion plate portion 152 and the gathering plate portion 154 is not limited. In the current embodiment of the present disclosure, a pair of dispersion plate portions 152 are disposed at both sides of the gathering plate portion 154, and the gathering plate portion 154 is formed between the pair of dispersion plate portions 152.

Each of the pair of dispersion plate portions 152 corresponds to the first bottom portion 121, and the gathering plate portion 154 may be formed to have a smaller height than that of each of the dispersion plate portions 152 so as to correspond to the second bottom portion 122. That is, the gathering plate portion 154 may be formed more concave than the adjacent dispersion plate portions 152.

The loading plate 150 may further include a reinforcement support portion 156.

The reinforcement support portion 156 is disposed to prevent the loading plate 150 from being deformed in multi-directions. The reinforcement support portion 156 is configured to prevent the loading plate 150 from being bent in a different direction from a direction in which the loading plate 150 is bent. The reinforcement support portion 156 is formed long on the gathering plate portion 154 and may be disposed so that the loading plate 150 can be bent around the gathering plate portion 154. The reinforcement support portion 156 is disposed at both sides of the gathering plate portion 154. When the loading plate 150 is in the second state P2, the gathering plate portion 154 may be bent in the different direction so that the gathered materials to be washed cannot be dropped.

The loading plate 150 may include a guide portion 158.

The guide portion 158 is configured in such a way that, when the loading plate 150 is in the second state P2, the materials to be washed do not slide off the loading plate 150.

Thus, the guide portion 158 is disposed at both ends of a portion where the loading plate 150 is deformed, so that the gathered materials to be washed may not slide off the loading plate 150. The guide portion 158 may be formed to be bent upward from the ends of the loading plate 150. In the current embodiment of the present disclosure, the guide portion 158 may be disposed at both ends of the gathering plate portion 154.

The loading plate 150 may further include guide sidewalls 160.

The guide sidewalls 160 are configured to be disposed along at least a part of a perimeter of the bottom portion 120 and in such a way that the materials to be washed may not fall off the loading plate 150. The guide sidewalls 160 may be formed to be bent upward from the bottom portion 120.

A deformation prevention groove may be disposed between the guide sidewalls 160 and the guide portion 158, i.e., at both sides of the guide portion 158 so as to prevent the guide portion 158 and the guide sidewalls 160 from interfering with each other and being twisted.

The loading plate 150 may include a handle 162.

The handle 162 is disposed in such a way that the loading plate 150 and the materials to be washed may be removed from the basket 110, i.e., the loading plate 150 may be moved from the first state P1 to the second state P2. The shape and arrangement of the handle 162 are not limited. In the current embodiment of the present disclosure, a pair of handles 162 are disposed at both ends of the loading plate 150. In detail, one of the pair of handles 162 is disposed at an end of each dispersion plate portion 152 in consideration of loads of the materials to be washed and the loading plate 150.

A material used for forming the loading plate 150 may be a material having elasticity. For example, the loading plate 150 may be formed to have a material including at least one of rubber and silicon.

The rack assembly 100 may include a movement frame 170.

The movement frame 170 is disposed to support the basket 110 so that the rack assembly 100 may be pulled out from the washing tub 12. At least one movement roller 172 is disposed at the movement frame 170 so as to move along a movement rail (not shown) in the washing tub 12.

Hereinafter, operations of the rack assembly according to an embodiment of the present disclosure and the dishwasher having the same will be described.

Figure 7:
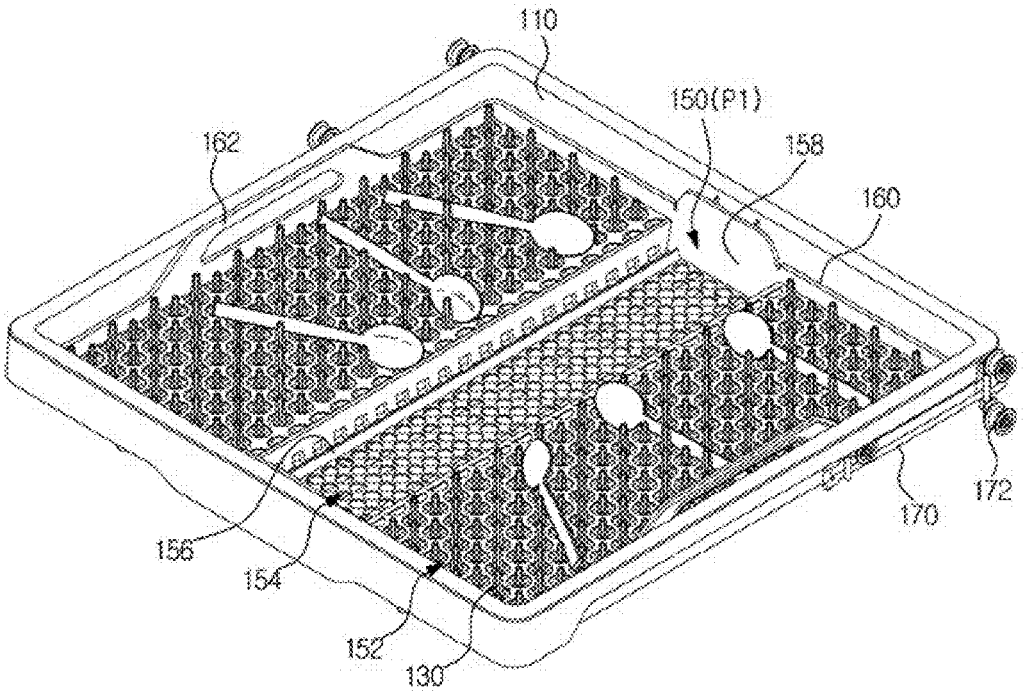
FIGS. 7, 8, and 9 are views of an operation of the rack assembly according to an embodiment of the present disclosure.
Figure 9:
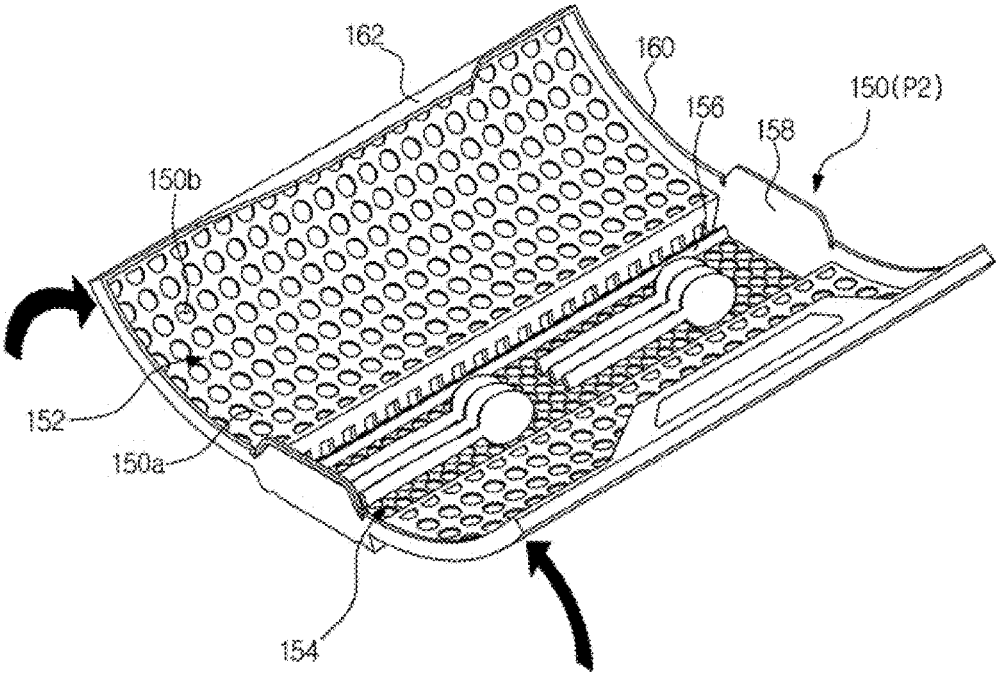

FIGS. 7, 8, and 9 are views of an operation of the rack assembly according to an embodiment of the present disclosure.

As illustrated in FIG. 7, after the loading plate 150 has been mounted on the basket 110 in the first state P1, the materials to be washed may be stacked on the loading plate 150. The stacked materials to be washed are supported by the support holders 130 that pass through the mounting holes 150*b* of the loading plate 150.

Since the support holders 130 are configured in such a way that the first support holders 131 and the second support holders 132 having a smaller height than that of the first support holders 131 are alternately disposed, even when the materials to be washed are not placed one by one but are dispersed with one drop on the loading plate 150, the materials to be washed may be disposed to be raised sideways due to a height difference between the support holders 130.

After the washing operation is finished, the handles 162 of the loading plate 150 are grasped and lifted, as illustrated in FIG. 8. The mounting holes 150*b* of the loading plate 150 are removed from the support holders 130 and thus are not bound to the basket 110 in the second state P2.

Since the loading plate 150 is disposed to be deformable, when the loading plate 150 is bent, as illustrated in FIG. 9, the materials to be washed placed on the loading plate 150 are gathered on the gathering plate portion 154 and thus may be easily collected.

As described above, in a rack assembly and a dishwasher having the same, loading and unloading of the materials to be washed can be easily performed so that a washing time can be reduced.

Furthermore, a stack structure in which a surface area in which the materials to be washed are in contact with washing water, is increased, is improved so that washing efficiency can be improved.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A rack assembly in which washing of articles is performed in a washing tub, the rack assembly comprising:

a basket in which a plurality of holes are formed; and a loading plate configured to be removable from the basket, wherein the loading plate has a first state and a second state, and is movable from the first state to the second state, the first state being a state in which the loading plate is mounted on the basket, and the second state being a state in which the loading plate is being removed from the basket by a user, and the loading plate is configured to be deformed elastically when the loading plate is moved from the first state to the second state, wherein the loading plate comprises a pair of dispersion plate portions formed on opposite sides of the loading plate, respectively, on which the articles are positionable when the loading plate is in the first state, a gathering plate portion centrally disposed between the pair of dispersion plate portions, the gathering plate portion being configured such that the articles are positionable thereon when the loading plate is in the second state, a pair of reinforcement support portions disposed at sides of the gathering plate portion adjacent the pair of dispersion plate portions, the pair of reinforcement support portions forming vertical steps relative to the gathering plate portion, and sidewalls formed around the loading plate and protruding upward, wherein portions of the sidewalls adjacent the gathering plate form a pair or guide sidewalls having a height that is higher than a height of portions of the sidewalls adjacent the pair of dispersion plate portions, wherein the pair of reinforcement support portions is configured to prevent the loading plate from being bent in a direction parallel to the sides of the gathering plate portion adjacent the pair of dispersion plate portions, and wherein the pair of reinforcement support portions and the pair of guide sidewalls are configured such that articles positioned on the pair of dispersion plate portions when the loading plate is in the first state become positioned on the gathering plate portion as the loading plate is deformed elastically when the loading plate is moved from the first state to the second state.

2. The rack assembly of claim 1, wherein the basket comprises a bottom portion, and a plurality of support holders that protrude from the bottom portion, and the loading plate comprises a loading portion disposed to face the bottom portion in the first state, and a plurality of mounting holes that are formed in the loading portion and are configured so that the plurality of support holders pass through the plurality of mounting holes in the first state.

3. The rack assembly of claim 2, wherein the plurality of support holders comprise:

first support holders; and second support holders each having a smaller height than that of each of the first support holders, and the first support holders and the second support holders are alternately disposed.

4. The rack assembly of claim 2, wherein the bottom portion comprises:

a first bottom portion; and a second bottom portion that is formed to have a lower height than that of the first bottom portion with respect to a floor of the washing tub.

5. The rack assembly of claim 4, wherein the plurality of support holders are formed on the first bottom portion.

6. The rack assembly of claim 2, wherein the plurality of support holders are arranged in a plurality of lines.

7. The rack assembly of claim 2, wherein the mounting holes are formed to have a larger cross-sectional area than that of each of the support holders.

8. The rack assembly of claim 2, wherein the loading plate and the bottom portion contact each other when the loading plate is in the first state.

9. The rack assembly of claim 1, wherein, when the loading plate is moved from the first state to the second state, the loading plate is deformed by weights of the articles on the loading plate.

10. The rack assembly of claim 1, wherein the loading plate is deformable so that the gathering plate portion is disposed to be lower than the pair of dispersion plate portions.

11. The rack assembly of claim 1, wherein the gathering plate portion is formed to be more downwardly concave than the pair of dispersion plate portions.

12. The rack assembly of claim 1, wherein each end of the loading plate includes a handle configured to be gripped by a user to remove the loading plate from the basket.

13. The rack assembly of claim 1, wherein the loading plate is formed with a material including at least one of rubber and silicon.

14. The rack assembly of claim 1, wherein the rack assembly further comprises a movement frame on which the basket is placed and which is disposed to be pulled out from the washing tub.

* * * * *